US005327702A

United States Patent [19]

Taylor

[11] Patent Number: 5,327,702

[45] Date of Patent: Jul. 12, 1994

[54] WRAPPING ARTICLES

[75] Inventor: Robert H. Taylor, High Wycombe, England

[73] Assignee: Molins plc, Milton Keynes, England

[21] Appl. No.: 922,853

[22] Filed: Jul. 31, 1992

[30] Foreign Application Priority Data

Aug. 1, 1991 [GB] United Kingdom ..... 9116608
Aug. 1, 1991 [GB] United Kingdom ..... 9116609

[51] Int. Cl.[5] ..... B65B 11/18; B65B 41/00; B65B 61/08

[52] U.S. Cl. ..... 53/389.3; 53/231; 53/389.5

[58] Field of Search ..... 53/389.3, 396, 466, 53/461, 228, 230, 231, 389.5

[56] References Cited

U.S. PATENT DOCUMENTS 3,367,221 2/1968 Schmermund ..... 53/389.3 X
4,351,142 9/1982 Focke et al. ..... 53/389.3 X
4,385,479 5/1983 Focke ..... 53/389.3
4,495,746 1/1985 Focke et al. ..... 53/389.3

FOREIGN PATENT DOCUMENTS

0095890A1 12/1983 European Pat. Off. .
2088769A 6/1982 United Kingdom .

*Primary Examiner*—James F. Coan
*Attorney, Agent, or Firm*—Antonelli, Terry, Stout & Kraus

[57] ABSTRACT

In a machine for wrapping articles such as cigarette packets, feed rolls deliver a wrapper web onto a suction drum at a controlled speed which is less than the peripheral speed of the drum. The drum carries a cutter blade which cooperates with a fixed blade to sever successive leading sections of the web which are conveyed from the drum by a delivery conveyor moving at the same speed as the drum. Eccentric pinch rollers momentarily grip each wrapper section to assist separation from the web. The delivery conveyor transfers the wrapper sections to a further conveyor which conveys successive sections across the path of articles to be wrapped. The further conveyor has a lower run for diverting the leading portion of each wrapper section away from the article conveyor.

16 Claims, 2 Drawing Sheets

WRAPPING ARTICLES

Figure 1:
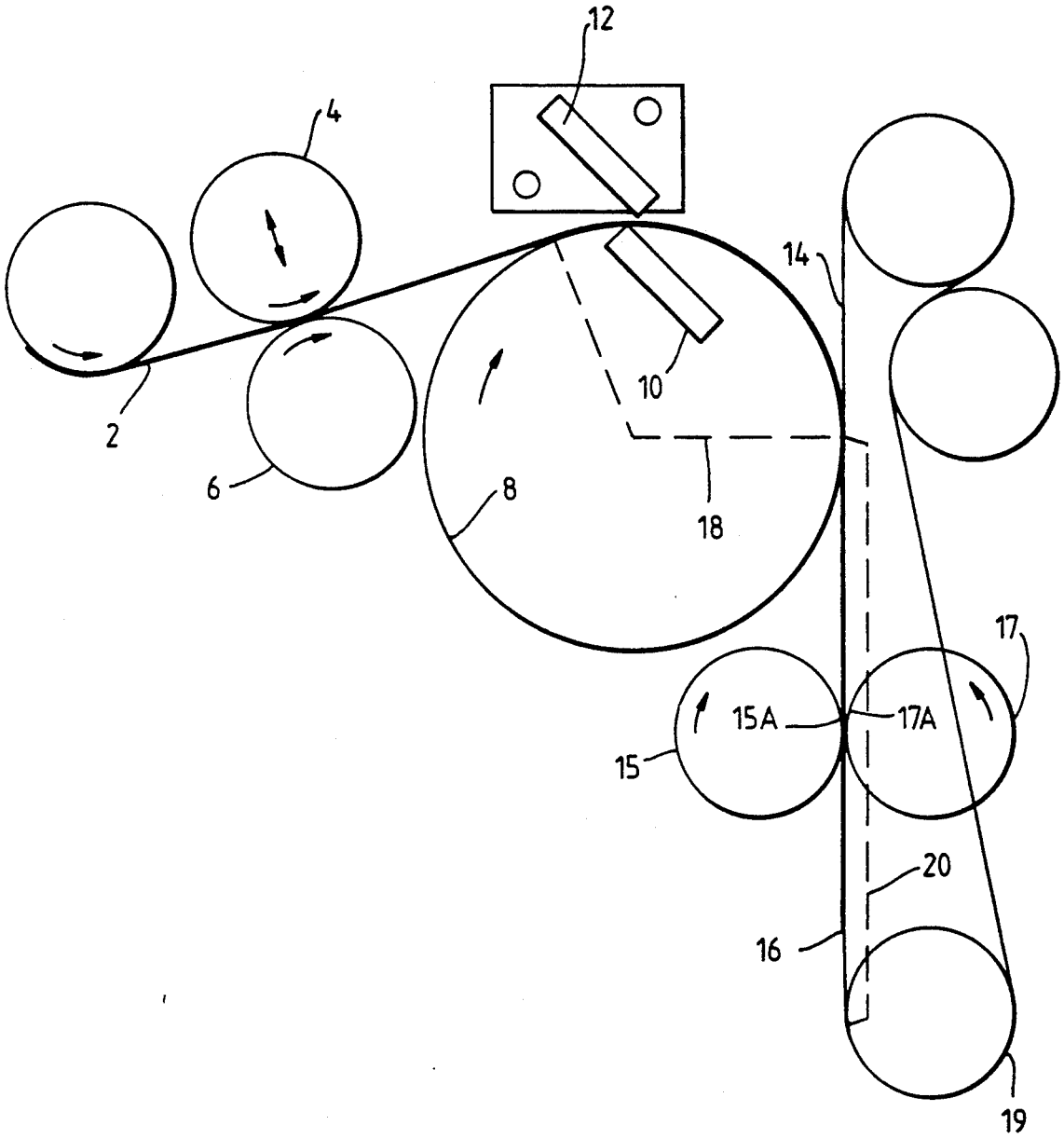

This invention relates to wrapping articles, and in particular to an apparatus and method for wrapping articles such as cigarette packets in a wrapper such as transparent plastics film.

In UK patent specification No. 1171762 there is disclosed an arrangement for feeding foil to a packing machine and severing it while it passes around a suction drum. The preferred form of the severing means is as disclosed in UK patent specification No. 1037261, which shows a rotary knife rotatable about a shaft lying within the drum and offset from its axis. The rotary knife operates through circumferential spaced openings in the drum to cooperate with a fixed knife to sever the foil.

According to one aspect of the invention a wrapping machine comprises means for feeding a wrapper web at a first speed, a suction conveyor for receiving the web from the feeding means, means for driving the suction conveyor at a second speed which is greater than said first speed, severing means including a first element carried by said suction conveyor and a second element which cooperates with said first element to sever the web at a predetermined position of said first element, and delivery conveyor means for receiving severed wrapper sections from the suction conveyor and for conveying them towards a position at which articles are wrapped, said delivery conveyor means including a substantially straight path for wrapper sections. The invention results in a machine having a wrapper severing arrangement which is simpler than that of the prior art arrangement referred to above.

Preferably the suction conveyor is a suction drum. Preferably the second element of the severing means is a stationary knife. Preferably the delivery means is driven at said second speed. The suction conveyor means may have suction control means for applying suction only in the region of the path on the conveyor which is occupied by the wrapper web or severed wrapper sections.

According to another aspect of the invention a method of feeding and severing a wrapper web in a wrapping machine comprises feeding the web at a controlled speed on to a suction drum having a higher speed than said controlled speed, severing the web with means which travels with the suction conveyor, and delivering severed wrapper sections from said conveyor at said higher speed along a straight path extending at a tangent to said drum.

In both aspects of the invention the web is preferably controlled and conveyed (e.g. by the suction conveyor) both upstream and downstream of the position of each cut, preferably up to, during and after the severing operation. Preferably each wrapper section is subjected to a cyclic pulling force to assist separation from the web after it has been severed. The pulling force could be provided by eccentric pinch rollers synchronised with the severing operation.

The wrapping machine may typically be for wrapping articles such as cigarette packets, e.g. as disclosed in UK patent specification No. 2215697A. Such machines for wrapping cigarette packets in transparent plastics wrapper film commonly provide for feeding spaced wrapper sections transversely across the path of spaced packets delivered in line. Each wrapper section is intercepted by a moving packet so that the section becomes partially wrapped around the packet. The packet continues to advance with the wrapper section into the wrapping machine where the wrapping and sealing of the section around the packet is completed. Since it is desirable for the packet to intercept a central portion of the wrapper section it is necessary to feed a leading portion of the wrapper section beyond the packet path prior to interception by the packet. Typically guide means, which may comprise an extension of a feed conveyor for the wrapper sections, extends beyond (i.e. crosses) the packet path. Such guide means can potentially impede or at least complicate the preferred form of the conveyor means which conveys the packet through and beyond the position at which it is intercepted by the wrapper section.

According to another aspect of the invention a wrapping machine comprises means for feeding wrapper sections on a first path, means for conveying articles to be wrapped on a second path which intercepts said first path at a wrapping position so that an article moving on said second path intercepts a wrapper section on said first path and becomes partially enveloped in it, including guide means for successive leading portions of said wrapper sections on said first path downstream of said wrapping position and arranged to divert said portions from the path of said conveying means. Preferably said first path has a first portion extending up to said wrapping position and a second portion extending beyond said wrapping position, said second portion being inclined relative to said first portion. Preferably said conveying means is arranged to convey said articles on said second path beyond said wrapping position.

In a preferred arrangement the guide means extends parallel to the second path in a direction opposite to that of advancement of the articles by said conveying means. The leading portions of wrapper sections are thus diverted so that they lie substantially parallel to the plane they occupy after interception by the articles at the said wrapping position.

Figure 2:
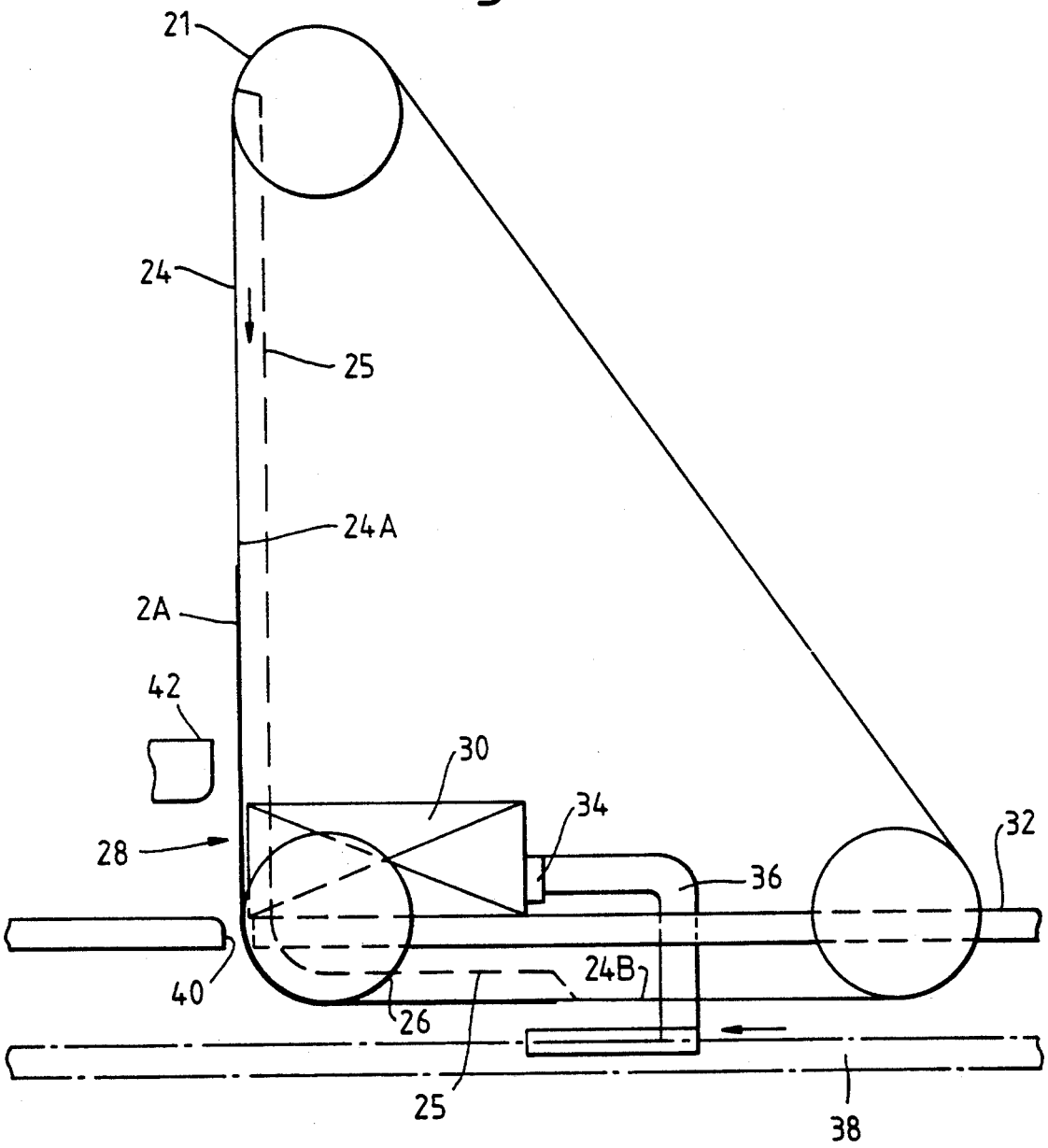

The invention will be further described, by way of example only, with reference to the accompanying diagrammatic drawings, in which:

FIG. 1 is a side view of apparatus for severing a wrapper film web in a machine for wrapping cigarette packets in transparent plastics film, and FIG. 2 is a side view of apparatus for wrapping cigarette packets in wrapper sections of transparent plastics film in the machine of FIG. 1.

Referring to FIG. 1 a web 2 is withdrawn from a reel (not shown) and fed at a controlled speed by pinch drive rollers 4,6. Downstream of the rollers 4,6 the web passes over a suction drum 8 which carries a cutter blade 10. The drum 8 is rotated at a peripheral speed which is higher than that of the drive rollers 4,6, and hence higher than that of the web 2. The cutter blade 10 cooperates with a stationary blade 12 to sever the web 2 into separate wrapper sections. The wrapper sections are received from the drum 8 on a suction band 14 which has a linear speed which is the same as the peripheral speed of the drum.

In the position shown in the drawing the cutter blade 10 is just about to sever a section from the web 2 at the blade 12. At this position the leading end of the web is approximately at position 16. The speed of the web 2 remains at that determined by the rollers 4,6, the drum 8 and suction band 14 slipping relative to the web. As soon as the wrapper section is cut by the blades 10,12 it is accelerated away at the speed of the drum 8 (and band 14), thereby creating a gap between it and the new leading end of the web 2.

In order to ensure that each wrapper section is accelerated away a pair of pinch rollers 15,17 is arranged to cyclically engage the wrapper section immediately after the web 2 is cut by the blades 10,12. For this purpose the rollers 15,17 have slight cam projections 15A,17A and are driven synchronously with the drum 8 so that each wrapper section is engaged by the projections for a short period to pull it away from the remaining web. Thus if the blades 10,12 have failed to sever the web 2 completely the action of the rollers 15,17 in momentarily gripping and pulling the wrapper section should nevertheless ensure its separation from the web. Apart from in the regions of the projections 15A,17A the rollers 15,17 do not grip the wrapper section. Instead of having projections 15A,17A the rollers 15,17 could be eccentrically mounted to achieve the same effect. The rollers 15,17 preferably rotate so that their peripheral speed is the same as that of the suction band 14.

The length of each wrapper section is equal to the distance travelled by the web 2 during one revolution of the drum 8. The web 2 is maintained under total control before, during and after the cut by virtue of its conveyance by the suction drum 8 and band 14. In particular the new leading end of each cut remains controlled and conveyed by the drum 8.

The suction drum 8 and suction band 14 cooperate with stationary suction manifolds which extend over the regions of the respective drum and band which form part of the path for the web or wrapper sections. The approximate extent of the respective manifolds is indicated at 18 and 20.

The band 14 is arranged so that wrapper sections are transferred to a further suction band 24 (FIG. 2). For this purpose one or both of the bands 14 and 24 comprise laterally-spaced parts and pass around correspondingly laterally-spaced coaxial pulleys 19 and 21 respectively.

In the apparatus shown in FIG. 2 spaced wrapper sections 2 are delivered to a vertical run 24A of the suction band 24. The band 24 has a lower horizontal run 24B separated from the vertical run 24A by roller 26. Stationary suction manifolds (indicated diagrammatically at 25) are provided for supplying suction to the runs 24A and 24B of band 24 and for maintaining suction in the vicinity of the roller 26.

The band 24 is effective to carry successive wrapper sections 2A to a wrapping position 28, at which the wrapper section is centrally positioned across the path of a packet 30. Successive packets 30 are conveyed along a generally horizontal surface 32 by spaced pushers 34 carried on brackets 36 connected to an endless conveyor 38. The surface 32 has a slot 40 so that the leading portions of the wrapper sections 2A below the wrapping position 28 can pass through the surface. Note that the wrapper sections 2A travel along a straight path from the drum 8 to the wrapping position 28.

The motion of the band 24 and conveyor 38 is continuous. In the position shown in the drawing the packet 30 is about to intercept the wrapper section 2A as the latter becomes centrally positioned relative to the packet path. At this time suction is switched off from the band 24. Subsequently the packet 30 and central portion of the wrapper section 2A are advanced through a mouthpiece formed by the surface 32 and an opposed upper surface 42, so as to partially wrap the section around the packet 30. Continued movement of the packet 30 under the action of the pusher 34 causes the wrapper section 2A to become further wrapped around the packet generally in a U-shape. The pusher 34 continues to advance the packet through and beyond the wrapping position 28 up to a position (not shown) where it is transferred to further conveyor means taking it through subsequent parts of the wrapping machine.

The shape of the bracket 36 with the pusher 34 cantilevered ahead of a main part of the bracket assures that the pusher and bracket do not interfere with the wrapper section after it has been wrapped around the packet in a generally U-shape.

Diverting the leading portion of each wrapper section 2A along the lower run 24B of band 24 allows the conveyor 38 to pass just below the wrapping position 28 without any possibility of interference with the wrapper section. Of course the conveyor 38 need not be located directly below the path of the packets 30 and could, for example, be located below and to one side of said path, with appropriately shaped brackets 36. Even where the path of conveyor 38 is located in a position where it would not normally have interfered with wrapper sections carried on a straight path through and beyond the wrapping position, there can be advantage in providing a diverted path for the wrapper sections, e.g. to reduce the overall height of the apparatus. Alternatively, in that case, suction may be applied only in the region of the band run 24A, so that the leading portion of each wrapper section is not conveyed by the band run 24B (and may, for example, simply hang vertically through the slot 40).

The apparatus shown in the drawings forms part of a wrapping machine, which may be generally of the type disclosed in said UK patent specification No. 2215697A. In this machine wrapping and sealing of the packets is completed while the packets are moving in line. During operation the wrappers and packets move continuously. Although the invention is particularly applicable to this type of machine it is in principle applicable to machines in which the wrapping and sealing stages are carried out in a different manner, e.g. while the packet is moving transversely in a turret or wheel. An example of this latter type of wrapping machine is disclosed in UK patent specification No. 2213456A.

I claim:

1. A wrapping machine comprising means for feeding a wrapper web at a first speed, a suction conveyor for receiving the web from the feeding means, means for driving the suction conveyor at a second speed which is greater than said first speed, severing means including a first element carried by said suction conveyor and a second element which cooperates with said first element to sever the web into wrapper sections at a predetermined position of said first element, and delivery conveyor means for receiving said severed wrapper sections from the suction conveyor and for conveying them towards a position at which articles are wrapped, said delivery conveyor means including cyclically-operated means synchronised with said severing means for assisting separation of successive wrapper sections from the web after severing by exerting a cyclic pulling force on said wrapper sections.

2. A wrapping machine comprising means for feeding wrapper sections on a first path, means for conveying articles to be wrapped on a second path which intercepts said first path at a wrapping position so that an article moving on said second path intercepts a wrapper section on said first path and becomes partially enveloped in it, and guide means for successive leading portions of said wrapper sections on said first path downstream of said wrapping position and arranged to divert said portions from the path of said article conveying means, wherein said guide means comprises conveyor means having a first straight portion extending up to said wrapping position and a second straight portion downstream of said wrapping position, said second portion being inclined relative to said first portion.

3. A machine as claimed in claim 2, wherein said second portion of said conveyor means extends in a direction parallel to the path of said article conveying means.

4. A wrapping machine comprising means for feeding a wrapper web at a first speed, a suction conveyor for receiving the web from the feeding means, means for driving the suction conveyor at a second speed which is greater than said first speed, severing means including a first element carried by said suction conveyor and a second element which cooperates with said first element to sever the web at a predetermined position of said first element, and endless delivery conveyor means for receiving severed wrapper sections from the suction conveyor and for conveying them towards a position at which articles are wrapped, said delivery conveyor means including means defining a substantially straight path for receiving wrapper sections directly from said suction conveyor.

5. A machine as claimed in claim 4, including means for driving the delivery conveyor means at said second speed.

6. A machine as claimed in claim 4, wherein the suction conveyor comprises a suction drum and said first element comprises a cutter carried by said drum.

7. A machine as claimed in claim 6, wherein the second element of the severing means comprises a stationary cutter.

8. A machine as claimed in claim 4, wherein the suction conveyor and delivery conveyor means are so arranged that successive leading portions of the web are conveyed by said suction conveyor and delivery conveyor means at said first speed prior to being severed from the remainder of the web.

9. A machine as claimed in claim 4, wherein the delivery conveyor means comprises at least one suction band conveyor.

10. A machine as claimed in claim 9, wherein said suction conveyor comprises a suction drum, said suction band conveyor including a straight run arranged at a tangent to said drum so as to receive wrapper web directly from said drum.

11. A machine as claimed in claim 4, wherein the delivery conveyor means includes cyclically-operated means synchronised with said severing means for assisting separation of successive wrapper sections from the web after severing.

12. A machine as claimed in claim 11, wherein said cyclically-operated means comprises opposed means for temporarily gripping and conveying successive wrapper sections after each severing operation.

13. A machine as claimed in claim 12, wherein the delivery conveyor comprises at least one suction band conveyor and said opposed means comprises a pair of pinch rollers having eccentric portions arranged to operate on a portion of each wrapper section while it is supported by a run of said suction band conveyor.

14. A machine as claimed in claim 4, wherein said delivery conveyor means is arranged to deliver wrapper sections along a first path further including means for conveying articles to be wrapped on a second path which intercepts said first path at a wrapping position so that an article moving on said second path intercepts a wrapper section on said first path and becomes partially enveloped in it, including guide means for successive leading portions of said wrapper sections on said first path downstream of said wrapping position and arranged to divert said portions from the path of said article conveying means.

15. A machine as claimed in claim 14, wherein said first path has a first portion extending up to said wrapping position and a second portion extending beyond said wrapping position, said second portion being inclined relative to said first portion.

16. A machine as claimed in claim 15, wherein the guide means extends parallel to the second path in a direction opposite to that of advancement of the articles by said article conveying means.

* * * * *